US008245792B2

(12) United States Patent
Trinh et al.

(10) Patent No.: US 8,245,792 B2
(45) Date of Patent: Aug. 21, 2012

(54) DRILL BIT WITH WEIGHT AND TORQUE SENSORS AND METHOD OF MAKING A DRILL BIT

(75) Inventors: Tu Tien Trinh, Houston, TX (US); Eric Sullivan, Houston, TX (US); Daryl Pritchard, Shenandoah, TX (US)

(73) Assignee: Baker Hughes Incorporated, Houston, TX (US)

( * ) Notice: Subject to any disclaimer, the term of this patent is extended or adjusted under 35 U.S.C. 154(b) by 19 days.

(21) Appl. No.: 12/198,670

(22) Filed: Aug. 26, 2008

(65) Prior Publication Data

US 2010/0051292 A1 Mar. 4, 2010

(51) Int. Cl.
*E21B 47/01* (2012.01)

(52) U.S. Cl. ..... 175/40; 175/315; 166/250.11

(58) Field of Classification Search ..... 175/57, 175/40, 315; 73/152.46; 166/250.11
See application file for complete search history.

(56) References Cited

U.S. PATENT DOCUMENTS

| | | | | |
|---|---|---|---|---|
| 3,411,361 | A * | 11/1968 | McLellan | 73/727 |
| 3,968,473 | A | 7/1976 | Patton et al. | |
| 4,445,578 | A * | 5/1984 | Millheim | 175/45 |
| 4,608,861 | A | 9/1986 | Wachtler et al. | |
| 4,821,563 | A | 4/1989 | Maron | |
| 4,941,951 | A | 7/1990 | Sheppard et al. | |
| 4,958,517 | A | 9/1990 | Maron | |
| 5,144,589 | A | 9/1992 | Hardage | |
| 5,386,724 | A | 2/1995 | Das et al. | |
| 5,415,030 | A | 5/1995 | Jogi et al. | |
| 5,448,227 | A | 9/1995 | Orban et al. | |
| 5,475,309 | A | 12/1995 | Hong et al. | |
| 5,720,355 | A | 2/1998 | Lamine et al. | |
| 5,813,480 | A | 9/1998 | Zaleski, Jr. et al. | |
| 6,057,784 | A | 5/2000 | Schaaf et al. | |
| 6,150,822 | A | 11/2000 | Hong et al. | |
| 6,186,248 | B1 | 2/2001 | Silay et al. | |
| 6,230,822 | B1 | 5/2001 | Sullivan et al. | |
| 6,419,032 | B1 | 7/2002 | Sullivan et al. | |
| 6,429,431 | B1 | 8/2002 | Wilk | |
| 6,510,389 | B1 | 1/2003 | Winkler et al. | |
| 6,540,033 | B1 | 4/2003 | Sullivan et al. | |
| 6,543,312 | B2 | 4/2003 | Sullivan et al. | |

(Continued)

FOREIGN PATENT DOCUMENTS

EP 0054475 A1 6/1982

OTHER PUBLICATIONS

Dateline Los Almos, a Monthly Publication of Los Almos National Laboratory, Jan. Issue 1997, pp. 1-8.

(Continued)

*Primary Examiner* — William P Neuder
*Assistant Examiner* — Robert E Fuller
(74) *Attorney, Agent, or Firm* — Cantor Colburn LLP

(57) ABSTRACT

A drill bit made according to one embodiment includes at least one of a weight sensor and a torque sensor configured to provide signals representative of the weight and torque on the drill bit when the drill bit is used for cutting into a formation. A circuit may be configured to process signals from the weight and torque sensors to provide an estimate of the weight and torque on the bit when the drill bit is used for cutting into the formation.

16 Claims, 4 Drawing Sheets

U.S. PATENT DOCUMENTS

| | | | | |
|---|---|---|---|---|
| 6,564,883 | B2 | 5/2003 | Fredericks et al. | |
| 6,571,886 | B1 | 6/2003 | Sullivan et al. | |
| 6,581,699 | B1 * | 6/2003 | Chen et al. | 175/61 |
| 6,626,251 | B1 | 9/2003 | Sullivan et al. | |
| 6,769,497 | B2 | 8/2004 | Dubinsky et al. | |
| 6,796,746 | B2 | 9/2004 | Jessmore et al. | |
| 6,850,068 | B2 | 2/2005 | Chemali et al. | |
| 7,046,165 | B2 | 5/2006 | Beique et al. | |
| 7,054,750 | B2 * | 5/2006 | Rodney et al. | 702/9 |
| 7,058,512 | B2 | 6/2006 | Downton | |
| 7,066,280 | B2 | 6/2006 | Sullivan et al. | |
| 7,143,844 | B2 * | 12/2006 | Alft et al. | 175/45 |
| 7,172,037 | B2 | 2/2007 | Dashevskiy et al. | |
| 7,207,215 | B2 | 4/2007 | Spross et al. | |
| 7,278,499 | B2 | 10/2007 | Richert et al. | |
| 7,308,937 | B2 | 12/2007 | Radford et al. | |
| 7,350,568 | B2 | 4/2008 | Mandal et al. | |
| 7,387,177 | B2 | 6/2008 | Zahradnik et al. | |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 2001/0054514 | A1 | 12/2001 | Sullivan et al. | |
| 2002/0152806 | A1 * | 10/2002 | Boucher et al. | 73/152.43 |
| 2004/0069539 | A1 | 4/2004 | Sullivan et al. | |
| 2004/0222018 | A1 | 11/2004 | Sullivan et al. | |
| 2005/0161258 | A1 | 7/2005 | Lockerd, Sr. et al. | |
| 2005/0194182 | A1 * | 9/2005 | Rodney et al. | 175/24 |
| 2005/0200498 | A1 * | 9/2005 | Gleitman | 340/854.4 |
| 2006/0065395 | A1 * | 3/2006 | Snell | 166/255.2 |
| 2006/0175057 | A1 | 8/2006 | Mandal et al. | |
| 2006/0272859 | A1 * | 12/2006 | Pastusek et al. | 175/40 |
| 2007/0105339 | A1 * | 5/2007 | Faris | 438/455 |
| 2007/0114062 | A1 | 5/2007 | Hall et al. | |
| 2007/0186639 | A1 | 8/2007 | Spross et al. | |
| 2007/0272442 | A1 | 11/2007 | Pastusek et al. | |
| 2008/0060848 | A1 | 3/2008 | Pastusek et al. | |
| 2008/0065331 | A1 | 3/2008 | Pastusek et al. | |
| 2008/0066959 | A1 | 3/2008 | Pastusek et al. | |
| 2008/0223575 | A1 * | 9/2008 | Oldham et al. | 166/285 |
| 2009/0139768 | A1 * | 6/2009 | Castillo | 175/50 |
| 2009/0194274 | A1 * | 8/2009 | Del Castillo et al. | 166/250.01 |
| 2009/0266609 | A1 * | 10/2009 | Hall et al. | 175/45 |

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/...., pp. 1-5.

XRF Corporation, About CZT Detectors, http://xrfcorp.com/technology/about_czt_detectors.html, 1 sheet.

International Preliminary Report on Patentability for International Application No. PCT/US2010/039136.

Schultz, Roger L. et al.; "Oilwell Drillbit Failure Detection Using Remote Acoustic Sensing," Proceedings of the American Control Conference, Anchorage, AK May 8-10, 2002, pp. 2603-2608.

* cited by examiner

DRILL BIT WITH WEIGHT AND TORQUE SENSORS AND METHOD OF MAKING A DRILL BIT

BACKGROUND INFORMATION

1. Field of the Disclosure

This disclosure relates generally to drill bits that include sensors for providing measurements relating to a parameter of interest and the systems for using such drill bits.

2. Brief description Of The Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations (drilling parameters), behavior of the BHA (BHA parameters) and formation surrounding the wellbore being drilled (formation parameters). Drilling parameters include weight-on-bit ("WOB"), rotational speed (revolutions per minute or "RPM") of the drill bit and BHA, rate of penetration ("ROP") of the drill bit into the formation, and flow rate of the drilling fluid through the drill string. The BHA parameters typically include torque, whirl, vibrations, bending moments and stick-slip. Formation parameters include various formation characteristics, such as resistivity, porosity and permeability, etc.

Typically, torque-on-bit and the weight-on-bit (also referred to herein as "weight" or "load") are estimated using measurements made by sensors disposed on the BHA, i.e., away from the drill bit, which estimates may not be accurate. Therefore, there is a need for an improved apparatus for estimating the torque and weight-on-bit during drilling of a wellbore.

SUMMARY

An embodiment according to the disclosure is a drill bit that includes at least one of a weight sensor and a torque sensor in the drill bit body, wherein the weight sensor is configured to provide signals representative of the weight on the drill bit when the drill bit is used for drilling a wellbore and the torque sensor is configured to provide signals representative of the torque on the drill bit when the drill bit is used for drilling a wellbore.

Another embodiment of the disclosure provides a method of making a drill bit that includes: placing in a bit body of the drill bit at least one of a load sensor configured to provide signals corresponding to a weight on the drill bit when the drill bit is deployed for drilling a wellbore and a torque sensor configured to provide signals representative of the torque on the drill bit when the drill bit is deployed for drilling a wellbore.

Yet, another embodiment provides a bottomhole assembly for use in drilling a wellbore in an earth formation that includes a drill bit having a bit body and at least one of a weight sensor in the bit body configured to provide signals representative of the weight on the drill bit when the drill bit is deployed in the wellbore and a torque sensor in the bit body configured to provide signals representative of the torque on the drill bit when the drill bit is deployed in the wellbore. A processor downhole and/or at the surface may process the signals from the sensors to estimate the weight-on-bit and torque-on-bit during drilling of the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION

Figure 1:
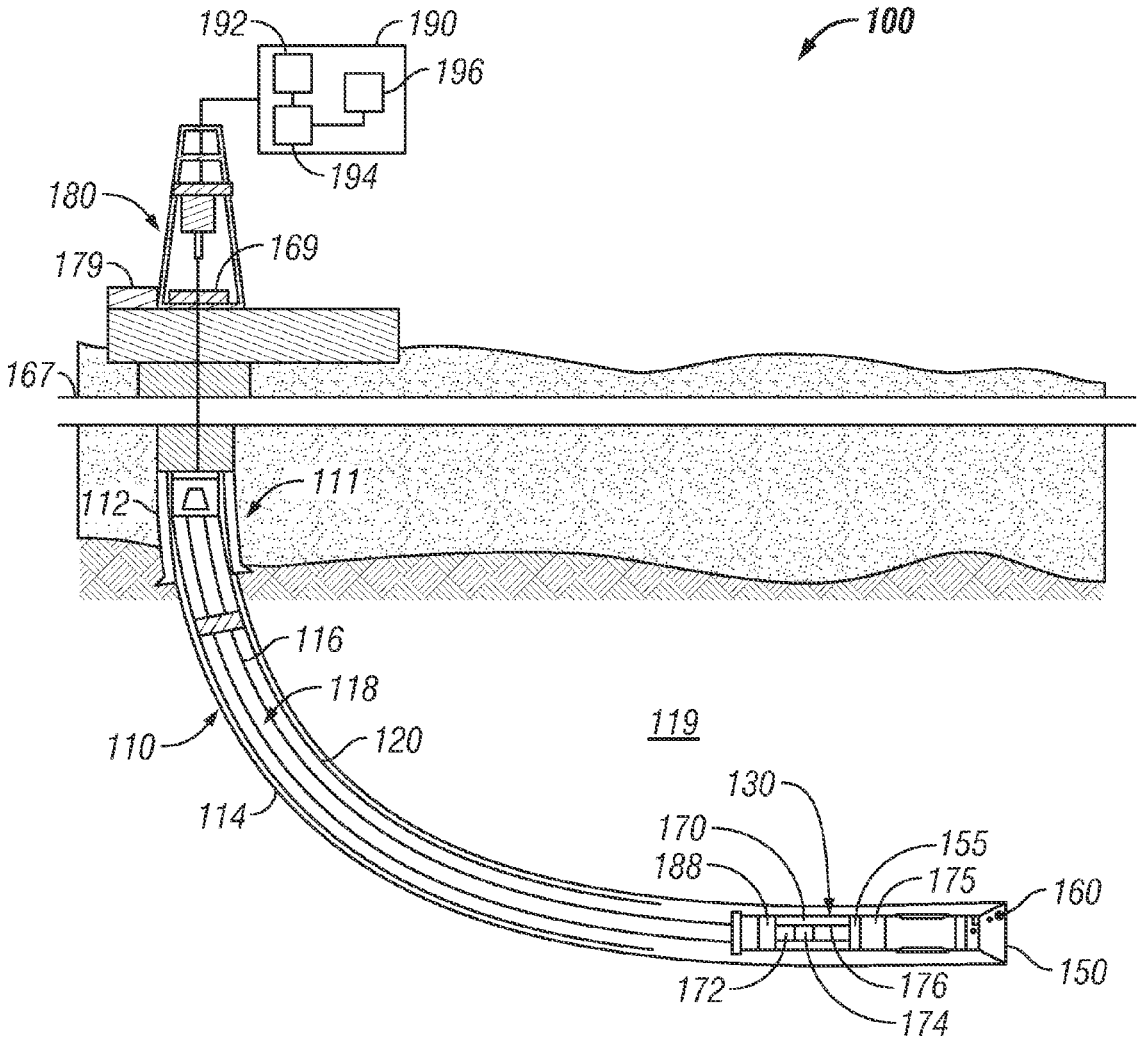
FIG. 1 is a schematic diagram of a drilling system that includes a drill string that has a drill bit made according to one embodiment of the disclosure for drilling wellbores.

FIG. 1 is a schematic diagram of an exemplary drilling system 100 that may utilize drill bits disclosed herein for drilling wellbores. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 (also referred to as the bottomhole assembly or "BHA") at its bottom end. The tubular member 116 may be made up by joining drill pipe sections or it may be coiled tubing. A drill bit 150 is attached to the bottom end of the BHA 130 for disintegrating the rock formation to drill the wellbore 142 of a selected diameter in the formation 119. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with offshore rigs used for drilling wellbores under water. A rotary table 169 or a top drive (not shown) coupled to the drill string 118 may be utilized to rotate the drill string 118 at the surface to rotate the drilling assembly 130 and thus the drill bit 150 to drill the wellbore 110. A drilling motor 155 (also referred to as "mud motors") may also be provided to rotate the drill bit. A control unit (or controller) 190, which may be a computer-based unit, may be placed at the surface 167 for receiving and processing data transmitted by the sensors in the drill bit and other sensors in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall of the wellbore 110.

Figure 2:
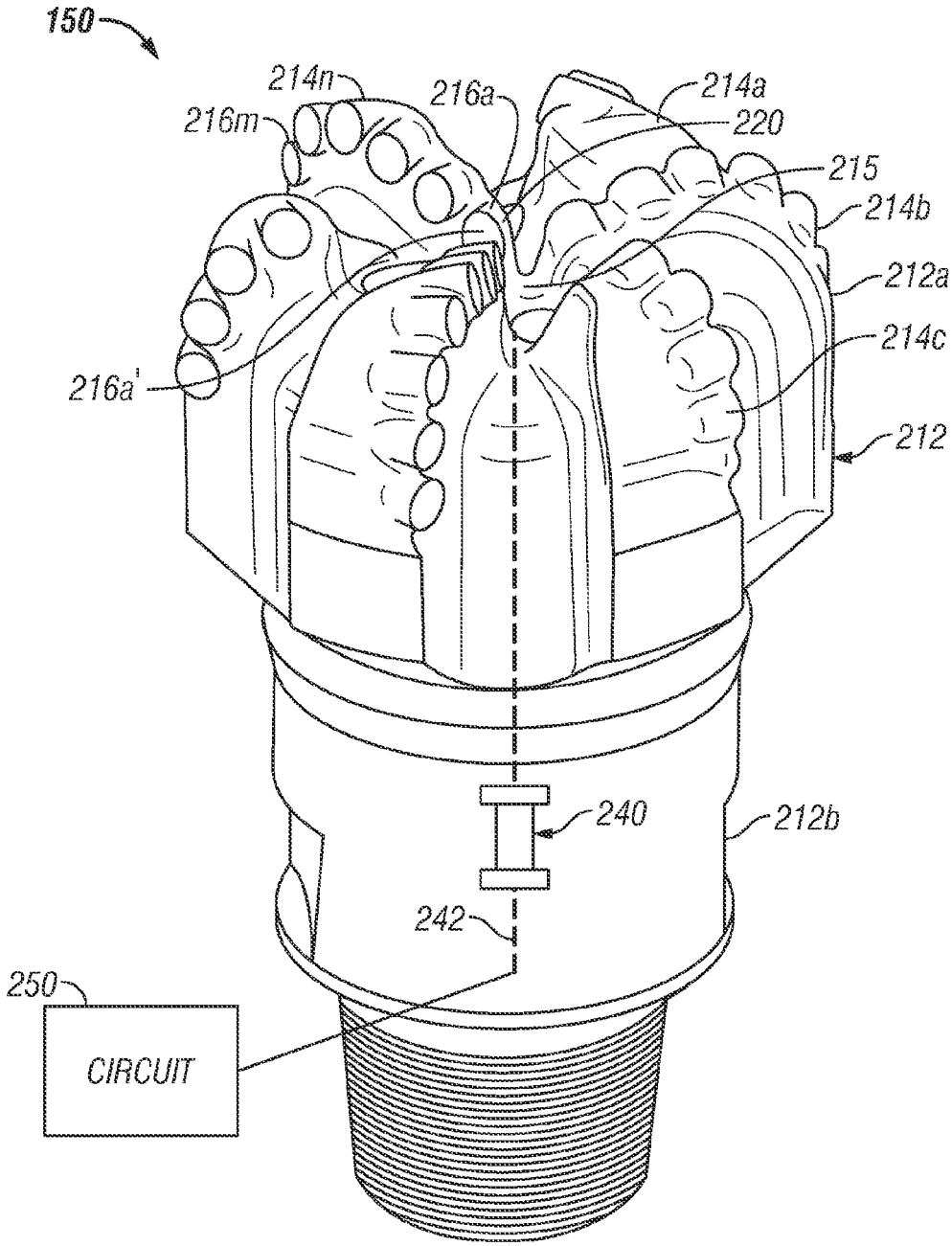
FIG. 2 is an isometric view of an exemplary drill bit showing placement of a weight sensor and a torque sensor in the drill bit and an electrical circuit for at least partial processing the signals generated by the weight and torque sensors according to one embodiment of the disclosure.
Figure 3:
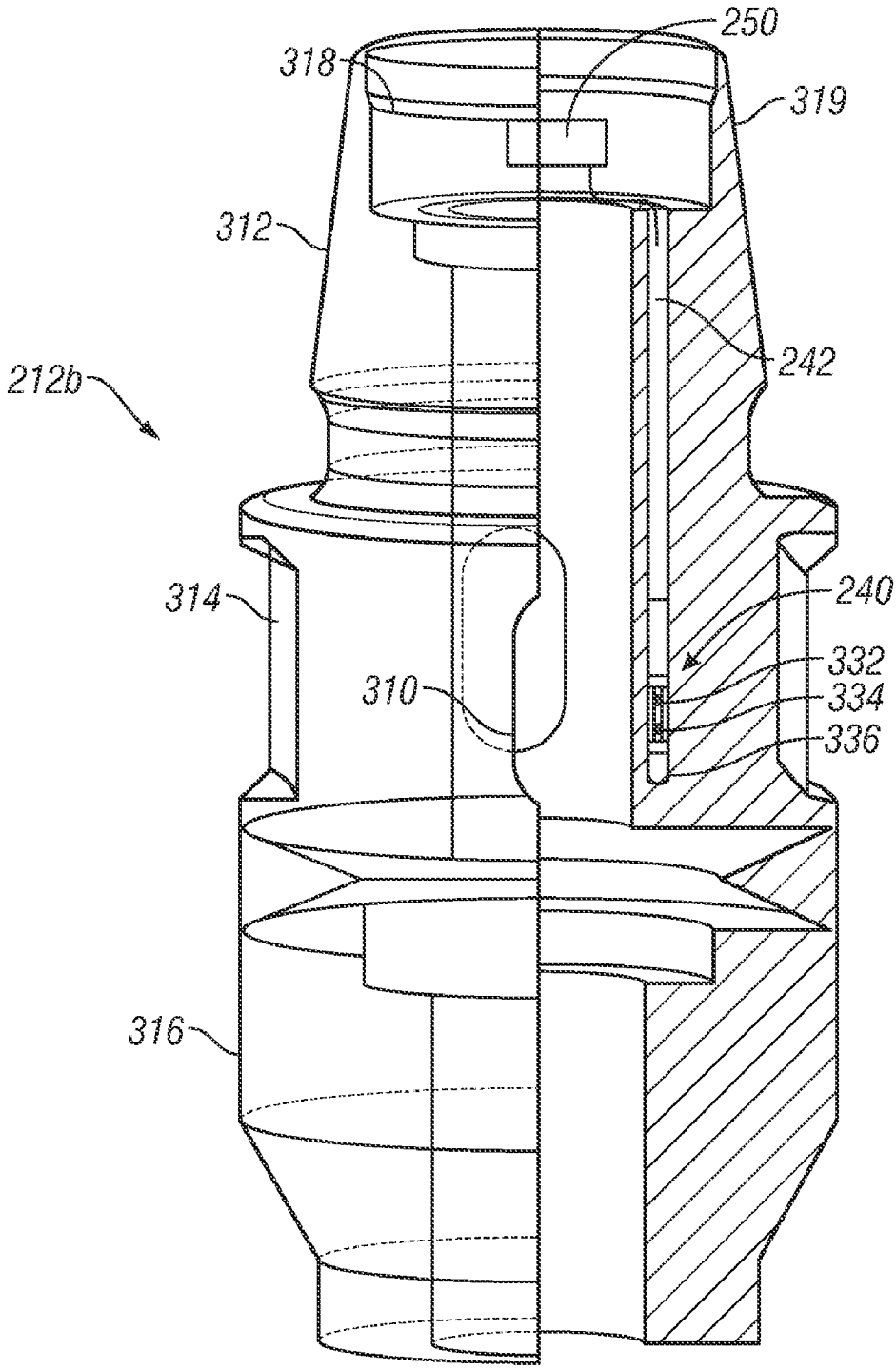
FIG. 3 shows the placement of the weight and torque sensors in the shank of an exemplary drill bit according to one embodiment of the disclosure.
Figure 4:
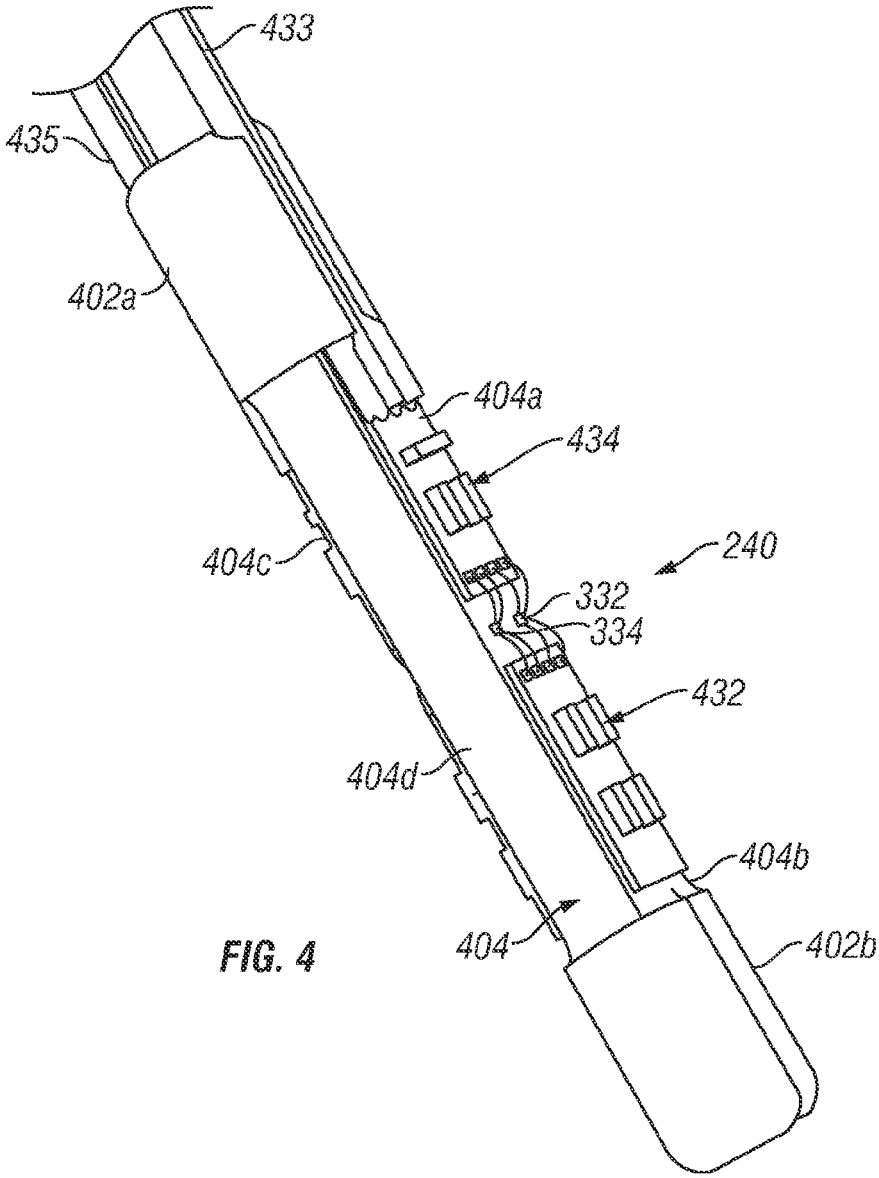
FIG. 4 shows certain details of the weight and torque sensors according to one embodiment of the disclosure for use in a drill bit, such as the drill bit disclosed in FIGS. 2 and 3.

Still referring to FIG. 1, the drill bit 150 includes one or more sensors 160 and related circuitry for estimating one or more parameters relating to the drill bit 150 and drilling assembly 130 as described in more detail in reference to FIGS. 2-4. The drilling assembly 130 may further include one or more downhole sensors (also referred to as the measurement-while-drilling (MWD) or logging-while-drilling (LWD) sensors (collectively designated by numeral 175) and at least one control unit (or controller) 170 for processing data received from the MWD sensors 175 and the drill bit 150. The controller 170 may include a processor 172, such as a microprocessor, a data storage device 174 and a program 176 for use by the processor to process downhole data and to communicate data with the surface controller 190 via a two-way telemetry unit 188. The data storage device may be any suitable memory device, including, but not limited to, a read-only memory (ROM), random access memory (RAM), Flash memory and disk.

FIG. 2 shows an isometric view of an exemplary drill bit 150 that includes a weight and torque sensor package 240 embedded therein according to one embodiment of the disclosure. A PDC drill bit is shown for explanation purposes. Any other type of drill bit may be utilized for the purpose of this disclosure. The drill bit 150 is shown to include a drill bit body 212 comprising a cone 212*a* and a shank 212*b*. The cone includes a number of blade profiles (or profiles) 214*a*, 214*b*, . . . 214*n*. A number of cutters are placed along each profile. For example, profile 214*a* is shown to contain cutters 216*a*-216*m*. All profiles are shown to terminate at the bottom of the drill bit 215. Each cutter has a cutting surface or cutting element, such as element 216*a*' of cutter 216*a*, that engages the rock formation when the drill bit 150 is rotated during drilling of the wellbore. Each cutter 216*a*-216*m* has a back rake angle and a side rake angle that defines the cut made by that cutter into the formation. In one aspect, the sensor package 240 may house both the weight and torque sensors. In another aspect, separate weight and torque sensors may be placed near each other or at different locations in the drill bit 150. In FIG. 2 these sensors are shown placed proximate to each other in the shank 212*b*. Such sensors also may be placed at any other suitable location in the drill bit 150, including but not limited to the crown 212*a*. Conductors 242 transmit signals from the sensor package 240 to a circuit 250 configured to process the sensor signals, which circuit may be placed in the drill bit, such as in the shank neck 219 or outside the drill bit, such as in the drilling assembly 130. The circuit 250, in one aspect, may be configured to amplify and digitize the signals from the weight and torque sensors.

FIG. 3 shows certain details of the shank 212*b* according to one embodiment of the disclosure. The shank 212*b* includes a bore 310 therethrough for supplying drilling fluid to the cone 212*a* of the drill bit 150 and one or more circular sections surrounding the bore 310, such as sections 312, 314 and 316. The upper end of the shank includes a recessed area 318. Threads 319 on the neck section 312 connect the drill bit 150 to the drilling assembly 130. The sensor package 240 containing the weight sensor 332 and the torque sensor 334 may be placed at any suitable location in the shank. In one aspect, the sensor package 240 may be placed in a recess 336 formed in a wall in section 314 of the shank 212*b*. Conductors 242 may be run from the sensors 332 and 334 to an electric circuit 250 in the recess 318. The circuit 250 may be coupled to the downhole controller 170 (FIG. 1) by conductors that run from the circuit 250 to the controller 170. In one aspect, the circuit 250 may include an amplifier that amplifies the signals from the sensor 332 and 334 and an analog-to-digital (A/D) converter that digitizes the amplified signals. In another aspect, the sensor signals may be digitized without prior amplification. The sensor package 240 is shown to house both the weight sensors 332 and torque sensors 334. The weight and torque sensors may also be separately packaged and placed at any suitable location in the drill bit 150.

FIG. 4 shows a sensor package 240 containing a weight sensor 332 and a torque sensor 334 made according to one embodiment for use in the drill bit 150. The sensor package 240 is shown to include end sections 402*a* and 402*b* that may be placed or anchored in conforming recesses 336 in the section 314 of the shank 212*b* (FIG. 3). The weight and torque sensors 332 and 334 may be placed on a surface 404*a* of a cantilever member 404 that is bounded by the end sections 402*a* and 402*b*. In the exemplary embodiment of FIG. 4, sensors 332 and 334 are shown formed as micro-machined piezo-resistive sensors formed on the surface 404*a*. In one aspect, these micro-machined sensors may have a gage resistance greater than 3000 ohms. The weight and torque sensors 332 and 334 also may be placed on the one or more remaining surfaces (404*b*-404*d* ) of the cantilever member 404. The sensors 332 and 334 are shown coupled to their respective electrical circuits 432 and 434, which circuits may pre-amplify and digitize signals received from their respective sensors 332 and 334. In another embodiment, the sensors 332 and 334 may be foil strain gages. Such gages, however, have a resistance of about 35 o ohms and consume substantially more power than the micro-machined sensors. Although the sensors 332 and 334 are shown placed on the same surface 404*a* of the member 404, such sensors may be placed on different surfaces or more than one weight and/or torque sensor may be utilized. Additionally, FIG. 4 shows just one type of packaging for the weight and torque sensors for ease of explanation. Any other suitable packaging for each such sensor may be utilized. Signals from the weight and torque sensors 332 and 334 may be sent to the circuit 250 via conductors 433 and 435 respectively. Conductors 433 and 435 may also be coupled directly to the controller 170.

Referring to FIGS. 1-4, during drilling operations, the signals from the sensors 332 and 334 or the circuit 450 are sent to the controller 170, which processes such signals to determine the values of the weight-on-bit and torque-on-bit during drilling of the wellbore. The processor 172 in the controller 170 may control one or more drilling parameters based at least in part on one or more of the determined values of the weight and torque. In one embodiment, the processor 172 may be configured to send commands to alter the weight-on-bit or alter rotational speed of the drill bit 150. For example, such commands may be issued to reduce vibration, whirl, stick slip and/or oscillation of the drill bit 150, drilling assembly 130 and or the drill string 118 in order to more efficiently perform the drilling and to extend the life of the drill bit 150 and/or BHA. The sensor signals or the computed values of the weight-on-bit and torque-on-bit determined by the controller 170 may be sent to the surface controller 190 for further processing. In one aspect, the surface controller 190 may utilize any such information to cause one or more changes, including, but not limited to, altering weight-on-bit, rotational speed of the drill bit, and the rate of the fluid flow so as to increase the efficiency of the drilling operations and extend the life of the drill bit 150 and drilling assembly 130. In another aspect, the weight and torque values may be presented (such as in a visual form) to an operator for taking appropriate actions.

Thus, in one aspect, a drill bit according to one embodiment may include a bit body and a weight sensor in the bit body configured to provide signals representative of the weight on the drill bit when the drill bit is used for drilling a wellbore. In another aspect, the drill bit may include a torque sensor in the bit body configured to provide signals representative of the torque on the drill bit when the drill bit is used for drilling the wellbore. In another embodiment, the drill bit may include both the weight and torque sensors in the bit body. The weight and/or the torque sensors may be micro-machined sensors or piezoelectric sensors or any other type of sensors that are configured to withstand the downhole drilling environment. The weight and torque sensors may be attached to the bit body by any suitable mechanism, including, but not limited to, placing a section of the sensor in a compliant trough in the bit body, welding or brazing a member associated with the sensors to the bit body, and securing the sensors to the bit body by a removable mechanical device, such as a screw. In one aspect, the weight and torque sensors may be placed or etched on a common member to form the micro-machined part of the sensors. Electrical conductors may be utilized to connect the outputs from the sensors to a circuit, which circuit may be placed in the bit body, such as in recess in a neck of the drill body or another suitable location. The circuit in the bit body may be configured to at least partially process the signals from the sensors, including, but not limited to, amplifying the sensor signals and digitizing the raw or amplified signals.

Another embodiment according the disclosure is a bottom-hole assembly for use in drilling of a wellbore in an earth formation that includes a drill bit, at least one of a weight sensor and a torque sensor in the bit body, and a processor configured to process signals from such sensors to provide an estimate of at least one of the weight and the torque on the drill bit. In one aspect, the signals from the sensors may be partially processed in the drilling assembly and partially at the surface. The weight and torque estimates may be generated in-situ.

Another aspect of the disclosure provides a method of making a drill bit that includes placing in the drill bit at least one of a weight sensor configured to provide signals representative of a weight or load on the drill bit when the drill bit is deployed for drilling a wellbore and a torque sensor configured to provide signals representative of torque on the drill bit when the drill bit is deployed for drilling a wellbore. The method may further include placing in the drill bit a circuit configured to process signals from at least one of the weight sensor and the torque sensor. The method may further comprise attaching the weight sensor and the torque sensor in the bit body, wherein both the weight and torque sensors are micro-machined sensors placed on a common platform.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

What is claimed is:

1. A drill bit, comprising:

a bit body with a recess in a shank section, wherein the recess is separate from a flow path for drilling fluid; and a sensor package including a weight sensor on a member bound by end sections anchored in the recess, wherein the end sections have a larger transverse dimension than the member and wherein the weight sensor is configured to provide signals corresponding to weight or bending moment on the drill bit when the drill bit is used for drilling a wellbore.

2. The apparatus of claim 1, further comprising a torque sensor on the member configured to provide signals corresponding to torque on the drill bit when the drill bit is used for drilling the wellbore.

3. The drill bit of claim 2, wherein at least one of the weight sensor and the torque sensor is one of: a micro-machined sensor; and a piezoelectric sensor.

4. The drill bit of claim 2, wherein the weight sensor and the torque sensor are placed on a common base.

5. The drill bit of claim 1 further comprising a circuit in the bit body configured to at least partially process signals from the weight sensor.

6. A drill bit, comprising:

a bit body with a recess in a shank section, wherein the recess is separate from a flow path for drilling fluid;

a sensor package including a torque sensor on a member bound by end sections anchored in the recess, wherein the end sections have a larger transverse dimension than the member and wherein the torque sensor is configured to provide signals corresponding to torque on the drill bit when the drill bit is used for drilling a wellbore; and a sensor package including a weight sensor on the member bound by end sections anchored in the recess, wherein the end sections have a larger transverse dimension than the member and wherein the weight sensor is configured to provide signals corresponding to weight on the drill bit when the drill bit is used for drilling a wellbore.

7. The drill bit of claim 6, wherein the torque sensor is one of: a micro-machined sensor; and a piezoelectric sensor.

8. A method of making a drill bit, comprising:

placing on a member in a recess of a bit body shank section of the drill bit a sensor package including at least one of a weight sensor configured to provide signals representative of weight on the drill bit when the drill bit is deployed for drilling a wellbore and a torque sensor configured to provide signals representative of torque on the drill bit when the drill bit is deployed for drilling a wellbore, wherein the member is bound by end sections anchored in the recess and wherein the end sections have a larger transverse dimension than the member, wherein the recess is separate from a flow path for drilling fluid.

9. The method of claim 8, further comprising placing a circuit in the drill bit configured to process signals from the at least one of the weight sensor and the torque sensor.

10. The method of claim 9 further comprising placing both the weight sensor and the torque sensor on the member, wherein both the weight sensor and the torque sensor are micro-machined sensors placed on a common platform.

11. A drilling assembly for use in drilling of a wellbore in an earth formation, comprising:

a drill bit having a bit body with a recess in a shank section, wherein the recess is separate from a flow path for drilling fluid; and a sensor package including at least one of a weight sensor on a member bound by end sections anchored in the recess, wherein the weight sensor is configured to provide signals representative of a weight on the drill bit when the drill bit is deployed in the wellbore and a torque sensor on the member bound by end sections anchored in the recess, wherein the end sections have a larger transverse dimension than the member and wherein the torque sensor is configured to provide signals representative of a torque on the drill bit when the drill bit is deployed in the wellbore.

12. The drilling assembly of claim 11 further comprising a controller configured to process signals from the at least one of the weight sensor to provide an estimate of weight on bit and the torque sensor to provide an estimate of the torque on the bit.

13. The drilling assembly of claim 12, wherein at least a portion of a control circuit is placed in the drill bit.

14. The drilling assembly of claim 12 wherein the controller is further configured to communicate information relating to one of the weight sensor and the torque sensor to a surface control unit when the drilling assembly is deployed in the wellbore.

15. The drilling assembly of claim 11, wherein the at least one of the weight sensor and the torque sensor is one of: a micro-machined sensor; and a piezoelectric sensor.

16. The drilling assembly of claim 11, wherein a control circuit is configured to control an operation of the drilling assembly in response to one of a weight on bit and torque on bit.

* * * * *